US007946926B1

(12) United States Patent
Balardeta et al.

(10) Patent No.: US 7,946,926 B1
(45) **Date of Patent: *May 24, 2011**

(54) SHOT TRACKING

(75) Inventors: Joseph Balardeta, Encinitas, CA (US); Scott Denton, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/698,030

(22) Filed: Feb. 1, 2010

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2006.01) |

(52) U.S. Cl. ..... 473/222; 473/297; 473/407; 473/155; 473/286; 340/568.6; 340/539.13; 702/19; 463/36; 700/92

(58) Field of Classification Search ..... None
See application file for complete search history.

(56) References Cited

U.S. PATENT DOCUMENTS

| | | | | |
|---|---|---|---|---|
| 4,991,850 | A | 2/1991 | Wilhlem | |
| 7,118,498 | B2 * | 10/2006 | Meadows et al. | 473/407 |
| 7,163,468 | B2 | 1/2007 | Gibbs et al. | |
| 7,163,470 | B2 | 1/2007 | Galloway et al. | |
| 7,166,038 | B2 | 1/2007 | Williams et al. | |
| 7,214,143 | B2 | 5/2007 | Deshmukh | |
| 7,252,600 | B2 | 8/2007 | Murphy et al. | |
| 7,258,626 | B2 | 8/2007 | Gibbs et al. | |
| 7,258,631 | B2 | 8/2007 | Galloway et al. | |
| 7,273,419 | B2 | 9/2007 | Evans et al. | |
| 7,413,520 | B1 | 8/2008 | Hocknell et al. | |
| 2007/0046469 | A1 * | 3/2007 | Pempsell et al. | 340/572.1 |
| 2008/0207357 | A1 | 8/2008 | Savarese et al. | |
| 2008/0218351 | A1 * | 9/2008 | Corrado et al. | 340/572.4 |
| 2009/0017944 | A1 | 1/2009 | Savarese et al. | |
| 2009/0075761 | A1 | 3/2009 | Balardeta et al. | |
| 2009/0209358 | A1 | 8/2009 | Niegowski | |
| 2009/0233735 | A1 * | 9/2009 | Savarese et al. | 473/407 |
| 2010/0060428 | A1 * | 3/2010 | Lee et al. | 340/10.1 |
| 2010/0076692 | A1 * | 3/2010 | Vock et al. | 702/19 |
| 2010/0097208 | A1 * | 4/2010 | Rosing et al. | 340/539.13 |
| 2010/0144456 | A1 * | 6/2010 | Ahern | 473/222 |

* cited by examiner

*Primary Examiner* — Paul A. D'Agostino
(74) *Attorney, Agent, or Firm* — Michael A. Catania; Sonia Lari

(57) ABSTRACT

The present invention relates to shot tracking. More specifically, the present invention relates to a method and system for tracking shots of a golfer during a round of golf. One aspect of the present invention is a system for automatically tracking a golf club swung by a golfer. The system comprises a plurality of golf clubs. Each of the plurality of golf clubs comprises a device attached to a grip which is attached to a shaft which is attached to a golf club head. The device comprises a power source, a shock switch and a RFID component.

1 Claim, 8 Drawing Sheets

SHOT TRACKING

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to shot tracking. More specifically, the present invention relates to a method and system for tracking shots of a golfer during a round of golf.

2. Description of the Related Art

Golf clubs combine with the players swing to propel a ball toward a favored location and through a favored path. The orientation and speed of the club head at impact largely determines the ball path including carry distance and roll.

The prior discloses various methods and systems that enable automatic collection of golf data. One such example is U.S. Patent Publication Number 2008/0207357 issued to Savarese et al for Combined Range and Tag Finder. This publication discloses a method for measuring a distance and locating a golf ball. A semiconductor coupled to an antenna is embedded in the outer shell of the golf ball which interacts with a first receiver in a portable device. The receiver is capable of determining the location of the golf ball, by distance and direction of the golf ball relative to the portable device. The portable device further includes a second receiver to determine the location of the portable device and a microprocessor to determine coupled to both the first and second receiver to determine the direction and/or location of a fixed object to the portable device.

Another example U.S. Pat. No. 4,991,850 issued to Wilhlem for Golf Swing Evaluation System. This patent discloses a system comprising a golf club containing a sensor and an associated display for indicating the force and location of impact of the club head against a golf ball. The display can be located in the club grip or worn by the golfer.

Yet another example is U.S. Patent Publication 2009/0017944 issued to Savarese et al. for Apparatuses, Methods and Systems Relating to Automatic Golf Data Collecting and Recording. This publication discloses the use of RFID tagged balls and golf clubs enabling automatic recording of when of when and where a golf stroke occurs.

A further example is U.S. Patent Publication Number 2009/0209358 issued to Niegowski for System and Method for Tracking One or More Rounds of Golf. This publication discloses a system and method for tracking rounds of golf, including a tracking system to track a golfer's position on a golf course and a golf stroke information providing system for providing information about a golf stroke taken by a golfer. They system may also include a coordinating system to coordinate the information about the golf stroke with the information about the golfer's tracked position on the golf course.

Most golfers while playing a round of golf are focused on his or her game, and interruption will deter from the golfer's game.

The prior art is lacking in a method and system to automatically track a golfer's round of golf without requiring game interrupting input from the golfer.

BRIEF SUMMARY OF THE INVENTION

The present invention allows for a golfer to automatically track his or her performance during a round of golf. The golfer can then review the tracked information after the round.

One aspect of the present invention is a system for automatically tracking a golf club swung by a golfer. The system comprises a plurality of golf clubs. Each of the plurality of golf clubs comprises a device attached to a grip which is attached to a shaft which is attached to a golf club head. The device comprises a power source, a shock switch and a RFID component. The impact of a golf club of the plurality of golf clubs closes the shock switch to provide an electrical current from the power source to the RFID component for transmission of a signal. The signal comprises the type of golf club impacted. The power source comprises a battery, a resistor and a capacitor. The RFID component comprises a RFID transponder and a processor. A receiver for receiving the signal from the RFID component is also a part of the system. The receiver is a GPS unit and the receiver sores data for each shot by the golfer for a round of golf.

Another aspect of the present invention is a method for conserving power for a shot tracking device attached to the grip of a golf club. The method comprises striking an object with the golf club having a shot tracking device. The shot tracking device comprises a power source, such as a battery, in electrical communication with a resistor which is in electrical communication with a shock switch. The shock switch is in electrical communication with an enabler and an RFID component, the RFID component comprising a RFID transponder and a processor.

The shock switch is closed which allows power to flow to the RFID component. The power is drawn from the capacitor instead of directly from the battery. A signal is transmitted from the RFID component to a receiver and a confirmation signal is received at the RFID component from the receiver. The shock switch is opened after a set period time and the capacitor is recharged with power from the battery at a controlled rate due to the presence of a resistor.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
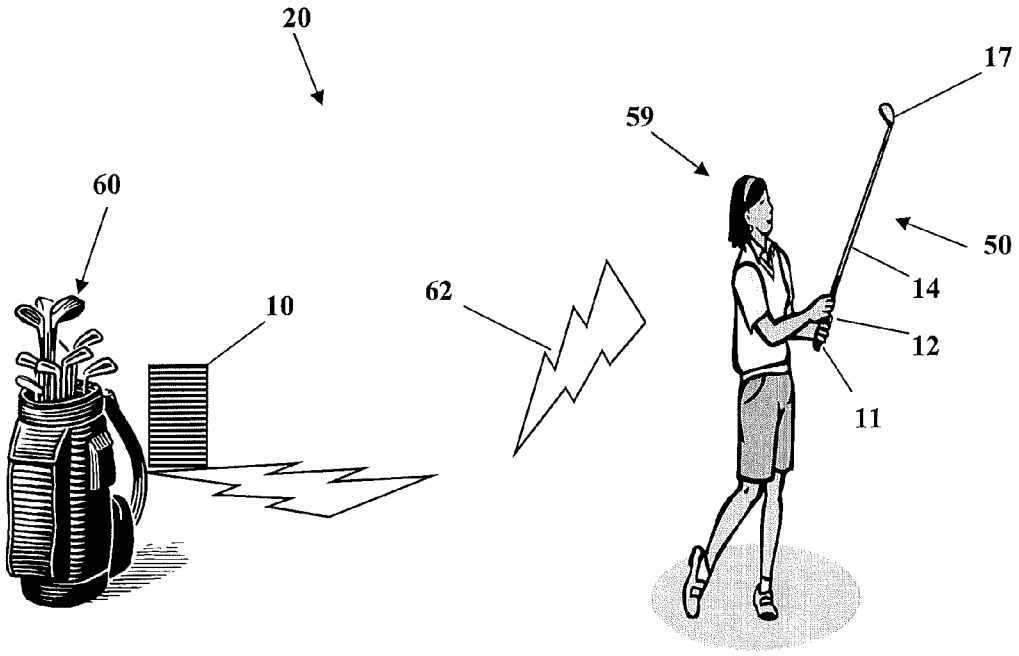
FIG. 1 is an illustration of a preferred embodiment of a system for shot tracking.

As shown in FIG. 1, a system 20 for automatically tracking a round of golf is generally designated. A RFID transponder 51(*a*) in a golf club 50 swung by a golfer 59 sends a signal 62 to a receiver 10. The receiver 10 is preferably attached to a golf bag 60, however, those skilled within the pertinent art will recognize that the receiver 10 may be attached to any pertinent device including the golfer 59, or may stand alone. Each golf club 50 has a device 11 attached thereto for automatically transmitting a signal 62 to a receiver 10 when a golfer 59 strikes a golf ball. As explained in greater detail below, the device 11 is preferably designed to transmit the signal 62 at impact. In this manner, a golfer 59 can play a round of golf while the system 20 automatically tracks the golfer's 59 shots without any input necessary from the golfer 59. As shown in the figures, the system 20 preferably comprises a plurality of golf clubs 50, with each golf club 50 having a shot tracking device 11, and a receiver 10 for receiving a signal 62 from the device 11 after each golf shot.

The present invention provides golfers 59 with information they need on course to make strong decisions about their game. The system 20 allows a golfer 59 to view drive distance and accuracy in context, review average golf club 50 distances before making a decision on which one to use, and see distances to green and hazards mapped to real course images. A device 11 is placed in the grip 12 of a golf club. The device 11 sends a signal 62 comprising which golf club 50 is being used, and sends this information to the receiver 10. The information is then stored in the receiver 10 and may be analyzed at a later point by connecting to a computer or may be viewed while on the golf course.

Figure 2:
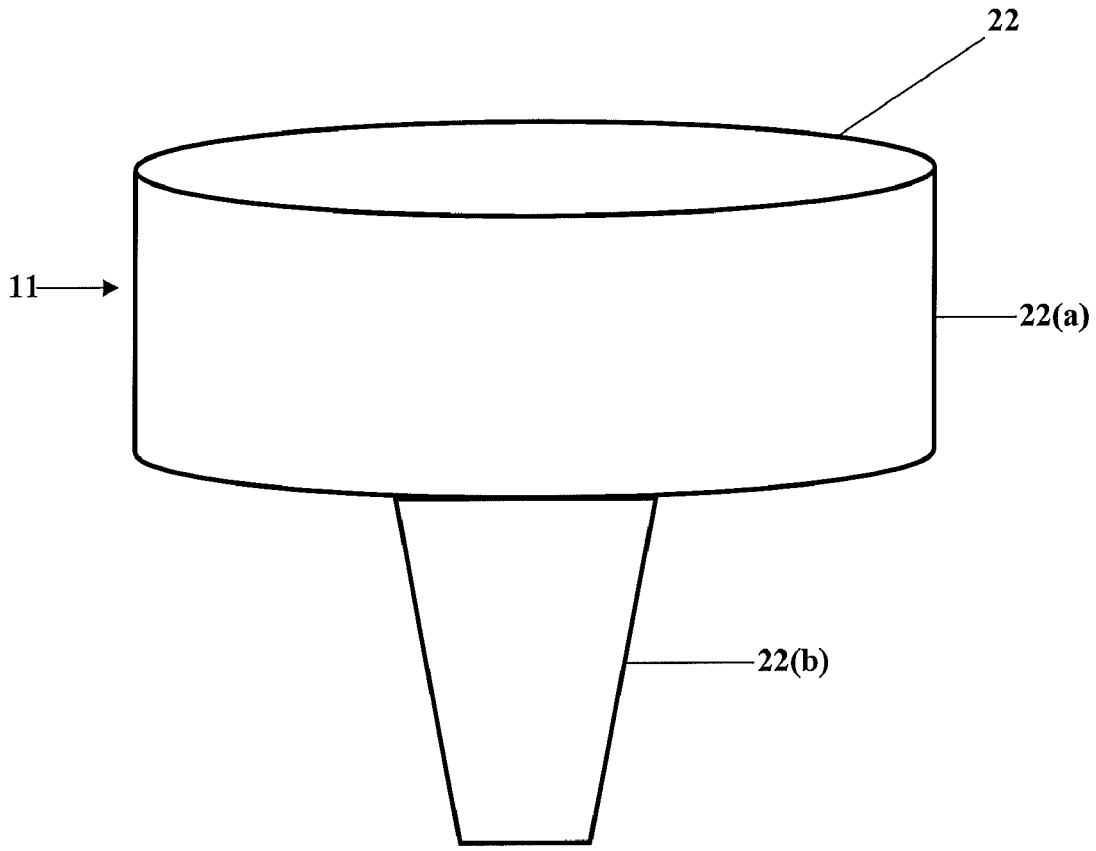
FIG. 2 is a perspective front view of a preferred embodiment for a system for shot tracking.
Figure 2A:
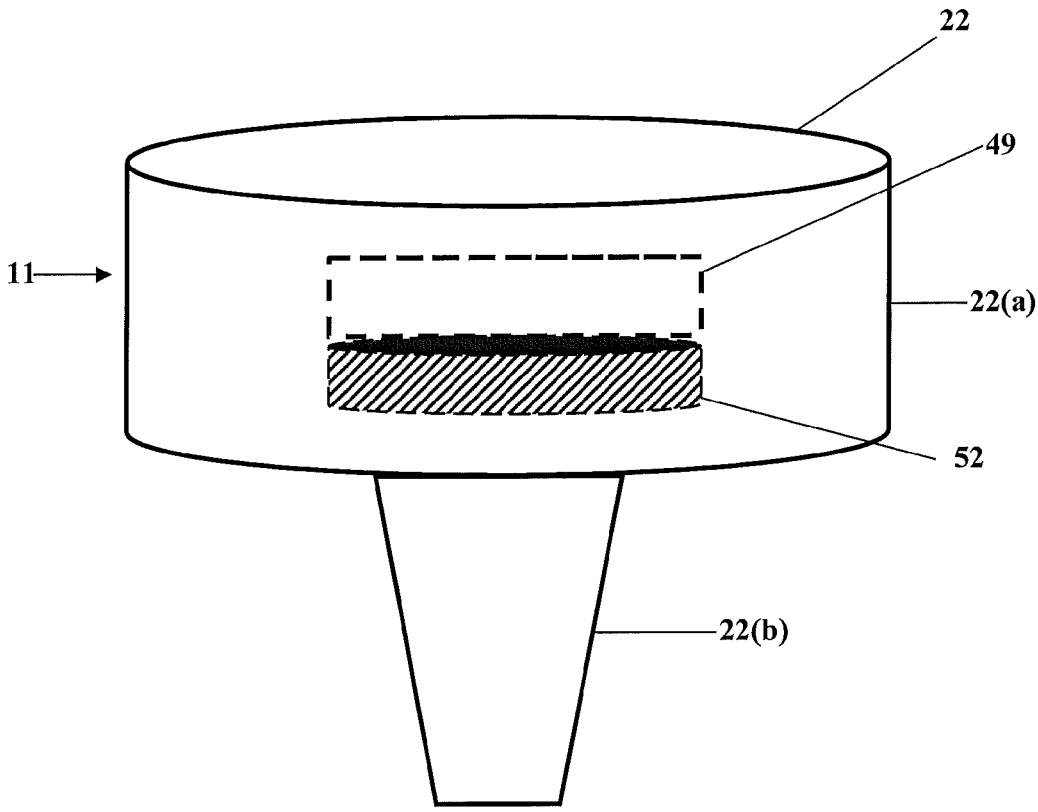
FIG. 2A is a perspective front view of a shot tracking device, showing a board and a power source.

Each of the plurality of golf clubs 50 comprises a device 11 attached to a grip 12 which is attached to a shaft 14 which is attached to a golf club head 17. FIGS. 2 and 2A illustrate a perspective view of the housing 22 of the components of the shot tracking device. The components of the system 20 within the golf club 50 preferably include an RFID component 51, a power source 52, a switch 53, an enabler 54, a resistor 55 and a capacitor 56.

As shown in FIGS. 2 and 2A, the device 11 of the present invention has a housing 22 preferably comprising a main body 22(*a*) and a projection body 22(*b*). The projection body 22(*b*) preferably has a length that ranges from 5 mm to 1 mm. The housing 22 preferably has a diameter, D, that ranges from 20 mm to 25 mm. The projection body 22(*b*) is inserted into the aperture in the grip 12 of the golf club 50.

Figure 3:
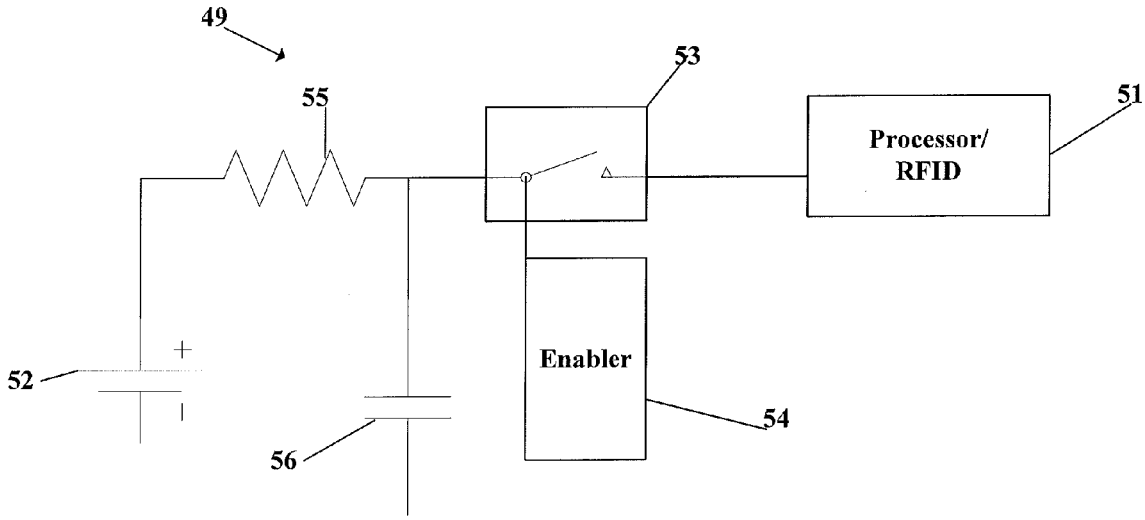
FIG. 3 is a circuit diagram of the components of a device for a system for shot tracking in a pre-impact state.

As shown in FIGS. 2-3, the device 11 comprises a power source 52, a shock switch 53 and a RFID component 51. The impact of a golf club 50 of the plurality of golf clubs 50 closes the shock switch 53 to provide an electrical current from the power source 52 to the RFID component 51 for transmission of a signal 62. The signal 62 comprises the type of golf club 50 impacted. The power source 52 comprises a battery 52(*a*), a resistor 55 and a capacitor 56. The RFID component 51 comprises a RFID transponder 51(*a*) and a processor 51(*b*). A receiver 10 for receiving the signal 62 from the RFID component 51 is also a part of the system 20. The receiver 10 is a GPS unit and the receiver 10 stores data for each shot by the golfer 59 for a round of golf. The receiver 10 is attached to a golf bag 60, however, those skilled in the pertinent art will recognize that the receiver 10 may be attached to any pertinent device including the golfer 59, or may stand alone.

Signals 62 may be transmitted via one or more antennas. Transmitted signals 62 may be formatted according to one or more system standards, including various examples detailed herein. Signals 62 may be transmitted on one or more frequencies (which may be selectable), or may be transmitted on multiple frequencies simultaneously (i.e. in Orthogonal Frequency Division Multiplexing (OFDM) systems. A data source provides data for transmission. The data source may be any type of data source or application, examples of which are well known in the art. Examples of components that may be included in a transceiver (or transmitter) are amplifiers, filters, digital-to-analog (D/A) converters, radio frequency (RF) converters, and the like. A transceiver or transmitter may also comprise modulators, spreaders, encoders, interleavers, equalizers and other functions. Data and/or control channels may be formatted for transmission in accordance with a variety of formats. RF transmission techniques are well known in the art and may include amplification, filtering, upconversion, mixing, duplexing, etc. Infrared formats (i.e. IrDA) or other optical formats may require additional components for transmitting optical signals 62. Various components may be configured to support a single communication format, or may be configurable to support multiple formats. Those of skill in the art will recognize myriad combinations of transmission components to support one or more communication formats in a plug-in network appliance in light of the teaching herein.

Figure 4:
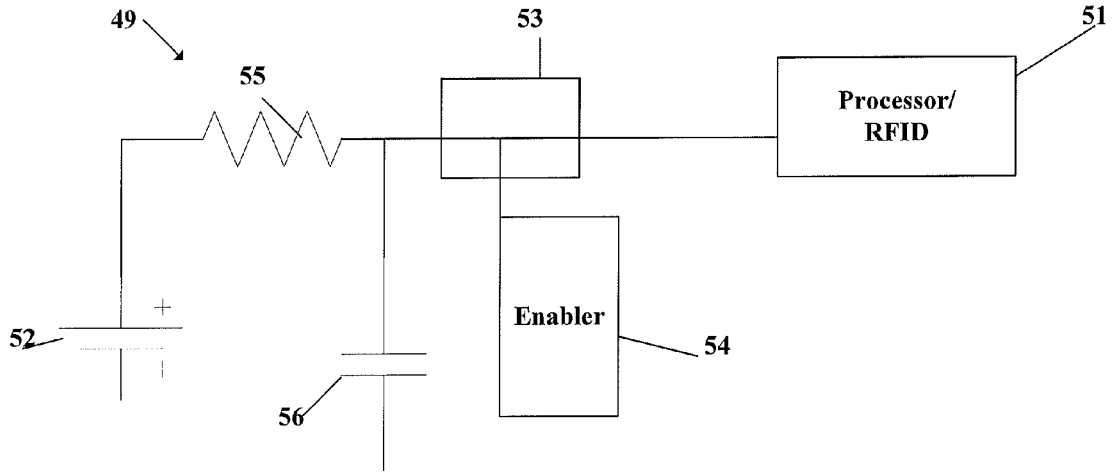
FIG. 4 is a circuit diagram of the components of a device for a system for shot tracking in a post-impact state.

As shown in FIGS. 3 and 4, a circuit 49 of the device 11 preferably comprises a power source 52, such as a battery 52(*a*), a resistor 55, a capacitor 56, a shock switch 53, an enabler 54, and a RFID component 51. The components of device 11 are preferably designed so as to reduce capacitor 56 leakage and conserve battery 52(*a*) power. The circuit 49 is designed with a resistor 55 located in series, following the battery 52(*a*) and prior to the capacitor 56, to minimize the pace at which the electrical current flows, allowing the capacitor 56 to reach the complete level of capacitance at a measured pace without quickly draining the battery 52(*a*). The benefits of coupling a resistor 55 with a capacitor 56 result in preventing the battery 52(*a*) from completely draining once the capacitor 56 is drained, as would happen if the capacitor 56 were directly connected to the battery 52(*a*). The capacitor 56 is preferably charged at a controlled rate from the battery 52(*a*).

FIG. 3 shows the circuit 49 for the device 11 prior to impact of the golf club 50 with a golf ball. FIG. 4 is an illustration of the circuit 49 of the device 11 subsequent to impact of a golf club 50 with a golf ball. As shown in FIG. 3, prior to the impact of the golf club 50 with the golf ball, the shock switch 53 is in an open position, preventing the electrical current from the power source 52 from reaching the RFID component 51. In this pre-impact state, the active RFID component is in a powerless dormant state. The capacitor 56 is fully charged awaiting for closure of the shock switch 53 in order to complete the circuit.

As shown in FIG. 4, subsequent to impact of the golf club 50 with the golf ball, the shock switch 53 is closed, which allows the electrical current from capacitor 56 to power the RFID component 51, activating the RFID component to generate a signal 62, for transmission to the receiver 10, without input from the golfer 59. The signal 62 comprises the type of golf club 50 struck by the golfer 59.

The various illustrative logical blocks, modules, and circuits described in connection with the embodiments disclosed herein may be implemented or performed with a general purpose processor 51(*b*), a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor 51(*b*) may be a microprocessor, but in the alternative, the processor 51(*b*) may be any conventional processor, controller, microcontroller, or state machine. A processor 51(*b*) may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor 51(*b*), or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor 51(*b*) such that the processor 51(*b*) can read information from, and write information to, the storage medium. In the alternative, the storage medium may be integral to the processor 51(*b*). The processor 51(*b*) and the storage medium may reside in an ASIC. The ASIC may reside in a user terminal. In the alternative, the processor 51(*b*) and the storage medium may reside as discrete components in a user terminal.

A preferred microprocessor 51(*b*) is a CYRF69103 provided by Cypress Perform. This microprocessor 51(*b*) is preferably a complete Radio System-on-Chip device, providing a complete RF system solution with a single device a few components. The microprocessor 51(*b*) preferably contains a 2.4 GHz Mbps GFSK radio transreceiver, packet data buffering, packet framer, DSSS baseband controller, Received Signal Strength Indication (RSSI), and SPI interface for date transfer and device configuration.

Alternatively, the processor 51(*b*) is a general-purpose microprocessor, a digital signal processor (DSP), or a special-purpose processor 51(*b*). The processor 51(*b*) is connected with special-purpose hardware to assist in various tasks (details not shown). Various applications (position based applications, for example, as well as any other type of applications) are run on externally connected processors 51(*b*), such as an externally connected computer, or over a network connection; may run on an additional processor 51(*b*) within network (not shown), or may run on processor 51(*b*) itself. The processor 51(*b*) preferably has a memory, such as RAM and non-volatile memory, which may be used for storing data as well as instructions for performing the various procedures and methods described herein. Those of skill in the art will recognize that memory may be comprised of one or more memory components of various types, that may be embedded in whole or in part within processor 51(*b*). In one embodiment, the processor 51(*b*) may be an Atmega, provided by Atmel of San Jose Calif., or a PIC18F8720 provided by Microchip of Chandler, Ariz.

A preferred load switch 53 is a AP2280 provided by Diodes Inc., which is a single channel slew rate controlled load switch. The AP2280 load switch has a quiescent supply current that is typically only 0.004 micro-amps, making it ideal for battery powered distribution system where the power consumption is a concern.

Preferably, the circuit 49 is also designed for conserving power for a shot tracking device 11 attached to the grip of a golf club 50. The shot tracking device 11 comprises a housing 22, a battery 52(*a*) in electrical communication with a resistor 55 which is in electrical communication with a shock switch 53. The shock switch 53 is in electrical communication with an enabler 54 and a microprocessor 51(*b*). The microprocessor 51(*b*) is in electrical communication with a radiofrequency circuit 51(*a*).

Prior to the impact of the golf club 50 with the golf ball, the shock switch 53 is in an open position, preventing the electrical current from the power source 52 from reaching the RFID component 51. In this pre-impact state, the active RFID component is in a powerless dormant state. The capacitor 56 is fully charged awaiting for closure of the shock switch 53 in order to complete the circuit.

Subsequent to impact of the golf club 50 with the golf ball, the shock switch 53 is closed, which allows the electrical current from capacitor 56 to power the RFID component 51, activating the RFID component to generate a signal 62, for transmission to the receiver 10, without input from the golfer 59. The signal 62 comprises the type of golf club 50 struck by the golfer 59.

The peak current for transmission of the signal 62 is preferably limited to 2 milli-amps. The radiofrequency circuit 51(*a*) preferably operates at 2.4 giga-Hertz. Preferably, the microprocessor 51(*b*) and the radiofrequency circuit 51(*a*) are integrated. The capacitor 56 is preferably a 1 micro-Faraday capacitor. The capacitor 56 is preferably a AP2280 provided by Diodes, Inc., which is a 1 micro-Faraday capacitor 56 composed of ceramic, which can withstand input current surges from low impedance sources, such as batteries in portable applications. The battery 52(*a*) is preferably a CR1620 having at least 75 milliamps of power. Alternatively, the battery 52(*a*) is a 3 volt battery.

The components of the system include a RFID component 51 which comprises a RFID transponder 51(*a*) and a microprocessor 51(*b*). The microprocessor 51(*b*) is configured to deactivate transmissions of the signal 62 when a threshold number of signals 62 are transmitted by the shot tracking device 11 and a receipt signal 62 is not received by the shot tracking device 11. The threshold number of signals ranges 62 from 5 to 50. The threshold number of signals 62 preferably ranges from 10 to 40, more preferably from 15 to 30 and is most preferred to be 20. Each signal 62 transmitted consumes approximately 2 milliamps of power. The signal 62 comprises a frequency of approximately 2.4 GHz.

Figure 5:
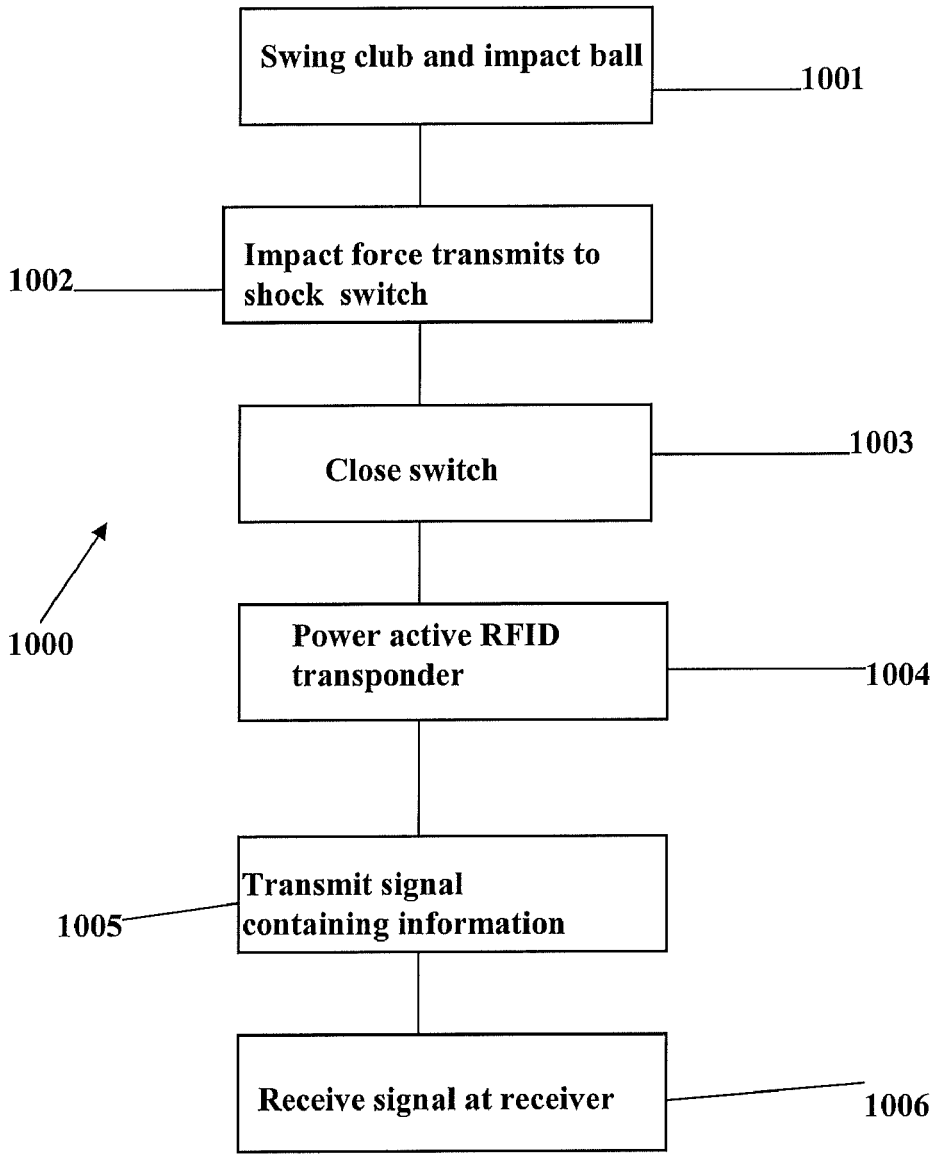
FIG. 5 is a flow chart of a method of shot tracking.

FIG. 5 is a flow chart of a method 1000 for shot tracking. At block 1001, a golfer 59 swings a club and impacts a golf ball. At block 1002, the impact force transmits to the shock switch 53. At block 1003, the shock switch is temporarily closed from the force of the impact. At block 1004, the active RFID transponder is powered by the power source. At block 1005, the active RFID transponder transmits at least one signal containing data about the golf club. At block 1006, the signal is received at a receiver.

Figure 6:
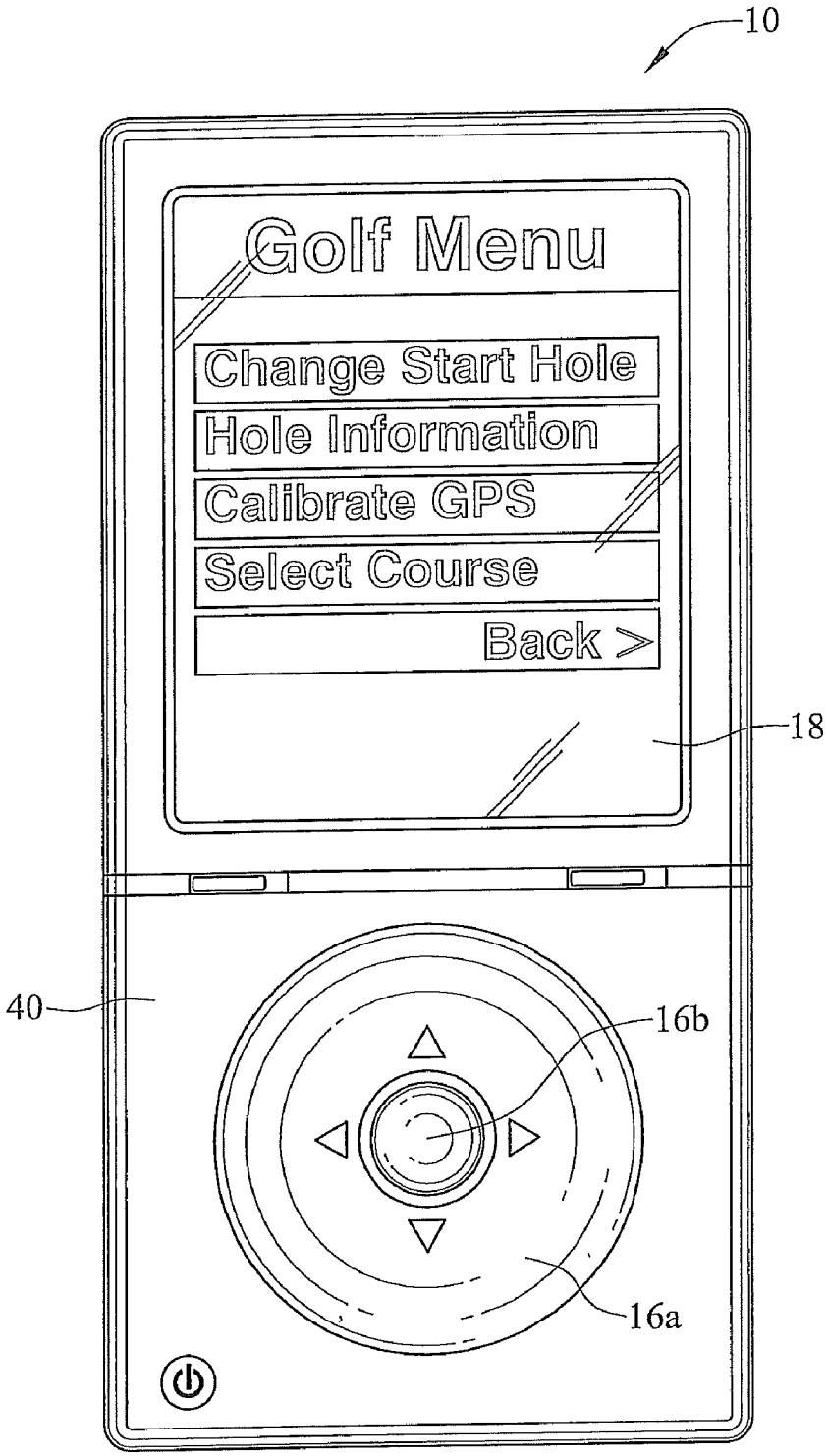
FIG. 6 is a front view of a preferred embodiment of a receiver for a system for shot tracking.

FIG. 6 is a perspective view of a preferred embodiment of the receiver 10 of the present invention, illustrating the display 18, front surface 40, and the directional pad 16(*a*) and a plurality of buttons 16(*b*).

Figure 7:
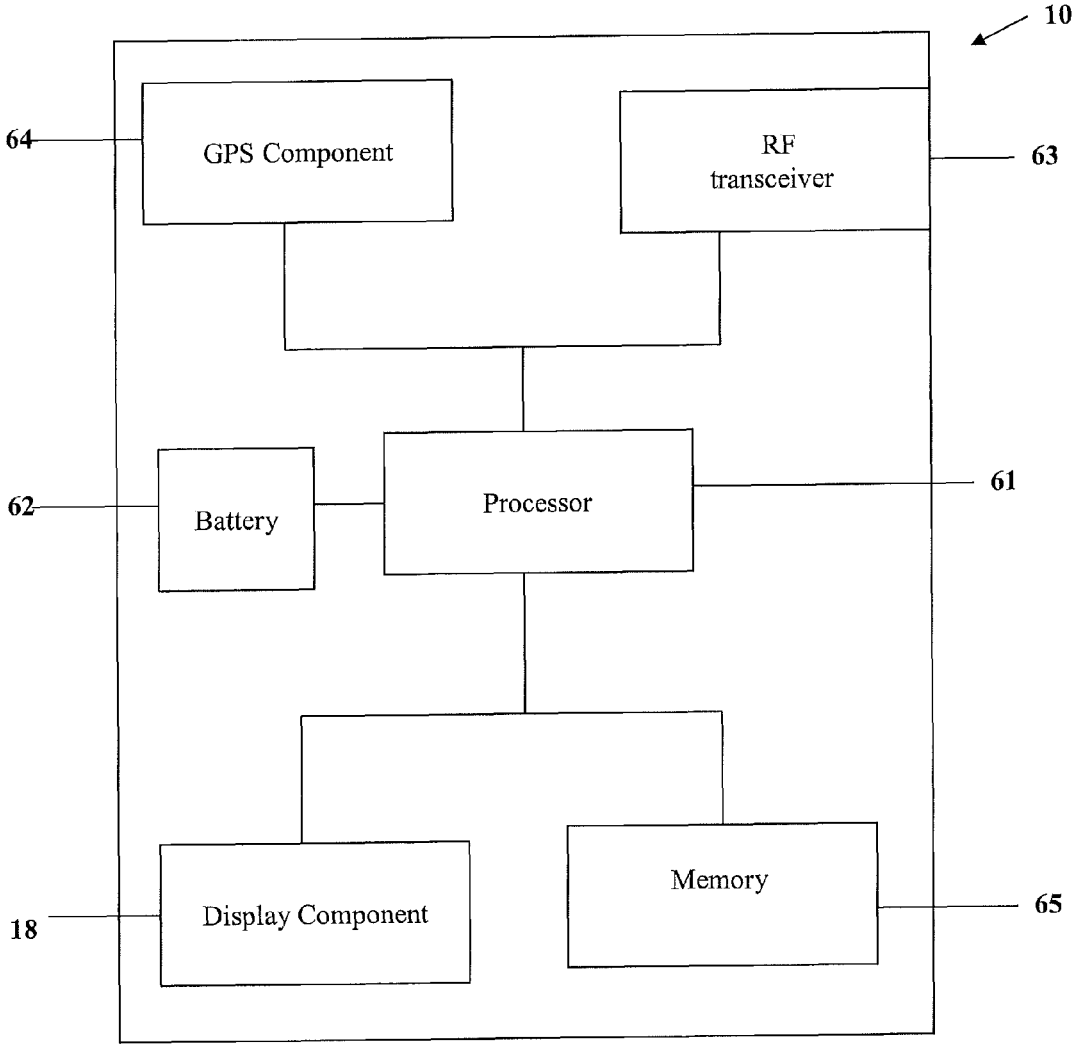
FIG. 7 is a block diagram of a preferred embodiment of the components for a receiver for a system for shot tracking.

FIG. 7 is a block diagram of a preferred embodiment of the components of the receiver 10. As shown in FIG. 7, a schematic block diagram of the preferred electronic components of the receiver 10 comprises a microprocessor 61 which is operably coupled to a GPS chipset 64, a LCD display 18; a program memory 65, RF transceiver 63 and a battery 62. The receiver 10 additionally may comprises a data transfer interface, a user interface and power management unit. As understood by one of ordinary skill in the art, the receiver 10 also comprises other electronic components, such as passive electronics and other electronics configured to produce a fully functional GPS device as described herein. In addition, the receiver 10 comprises various firmware and software configured to control the operation of the receiver 10 and provide the device functionality as described in more detail below.

The microprocessor 61 is preferably an ARM based microprocessor, such as one of the MX line of processors available from Freescale Semiconductor, but may be any other suitable processor. The microprocessor 61 executes instructions retrieved from the program memory 65, receives and transmits data, and generally manages the overall operation of the receiver 10.

The GPS chipset 64 is preferably an integrated circuit based GPS chipset which includes a receiver and microcontroller. The GPS chipset may be a single, integrated microchip, or multiple microchips such as a processor and a separate receiver which are operably coupled to each other (for example, on a printed circuit board ("PCB")). For instance, the GPS chipset 64 may be a NJ1030 GPS chipset available from Nemerix, Inc., or any other suitable GPS chipset or microchip. The GPS chipset 64 includes a GPS receiver, associated integrated circuit(s), firmware and/or software to control the operation of the microchip, and may also include one or more correction signal receiver(s) (alternatively, the correction signal receiver(s) may be integrated into a single receiver along with the GPS receiver). As is well known, the GPS unit 64 receives signals from GPS satellites and/or other signals such as correction signals, and calculates the positional coordinates of the GPS unit 64. The receiver 10 utilizes this positional data to calculate and display a golfer's position for shot tracking of the golfer's round of golf.

The display 18 may be any suitable graphic display, but is preferably a high resolution (e.g. 320 pixels by 240 pixels, QVGA or higher resolution), full color LCD. The display 18 is preferably the largest size display that can be fit into the form factor of the overall device 11, and preferably has a diagonal screen dimension of between about 1.5 inches and 4 inches. For example, for the form factor described below with reference to FIG. 6, the display may be a 2.2" diagonal, QVGA, full color LCD. In addition, since the display 18 is intended to be used outside under sunlit conditions, the display 18 should provide good visibility under brightly lit conditions, such as with a transflective LCD.

The program memory 65 preferably stores at least some of the software and data used to control and operate the receiver 10. For example, the program memory 65 may store the operating system (such as LINUX or Windows CE), the application software (which provides the specific functionality of the device 11, as described below), and the golf course data. The program memory 65 broadly includes all of the memory of the receiver 10, including memory contained on the microprocessor, memory in a non-volatile memory storage device such as flash memory, EPROM, or EEPROM, memory on a hard disk drive ("hdd"), SD Card(s), USB based memory devices, other types of flash memory, or other suitable storage device.

A user input device may comprise a plurality of buttons, a touch screen, a keypad, or any other suitable user interface which allows a user to select functions and move a cursor. Referring to the embodiment shown in FIG. 6, an example of a user input device comprises a directional pad 16(*a*) and plurality of buttons 16(*b*). The receiver 10 is configured such that directional pad 16(*a*) may be used to move a cursor around the display, while the buttons 16(*b*) may be used to make selections and/or activate functions.

In order to provide portability, the receiver 10 is preferably battery powered by a battery 62 and power management unit. The battery 62 may be any suitable battery, including one or more non-rechargeable batteries or rechargeable batteries. For instance, a rechargeable, lithium-ion battery would work quite well in this application, as it provides relatively long life on a single charge, it is compact, and it can be re-charged many times before it fails or loses significant capacity. The power management unit controls and distributes the battery power to the other components of the receiver 10, controls battery charging, and may provide an output representing the battery life. The power management unit may be a separate integrated circuit and firmware, or it may be integrated with the microprocessor 61, or other of the electronic components of the receiver 10.

The data transfer interface is preferably configured to send and receive data from the shot tracking device 11 and a computer. The interface also preferably includes a physical connection such as a USB connection, a radio frequency connection such as Wi-Fi, wireless USB, or Bluetooth, an infra-red optical link, or any other suitable interface which can exchange electronic data between the receiver 10 and the shot tracking device 11. In a preferred embodiment, the interface comprises a USB connection having a USB connector.

The electronic components of the receiver 10 are preferably assembled onto a PCB, along with various other electronic components and mechanical interfaces (thereby providing the electronic connections and operability for a functional electronic receiver 10.

The receiver 10 preferably comprises a housing 22 (as shown in FIG. 6) which houses the electronic components such that the entire receiver 10 has a very compact, thin, and lightweight form factor. The housing 22 may be formed of any suitable material, but is preferably a plastic material which is substantially transparent to radio frequency signals from GPS satellites. Indeed, the golf GPS device is preferably handheld and small enough to fit comfortably in a pocket of a user's clothing. In one preferred form, the receiver 10 may have the following dimensions: a height of about 4 inches or less, a width of 1.9 inches or less and a thickness of 0.6 inch or less. More preferably, the height is 3.9 inches or less, the width is 1.8 inches or less, and the thickness is 0.55 inches or less. The entire receiver 10 may weigh about 3.5 ounces or less, including the battery 62.

An application software program is stored in the program memory 65. The application software program is configured to operate with the microprocessor 61 and the other electronic components to provide the receiver 10 with the functionality as described herein. Most generally, the hardware and software of the receiver 10 are configured to determine, track, and display useful golf related information, before, during and after a round of golf.

The receiver 10 is preferably a GPS device such as disclosed in Balardeta et al., U.S. Patent Publication Number 20090075761 for a Golf GPS Device And System, which is hereby incorporated by reference in its entirety. Alternatively, the receiver 10 is a personal digital assistant (PDA), "smart phone", mobile phone, or other similar device. However, those skilled in the pertinent art will recognize that the receiver 10 may be any device capable of receiving and storing signals from the RFID tag.

Those skilled in the pertinent art will recognize that other wireless communications standard or specifications may also be deployed with the present invention. Example cellular-based data systems include: (1) the"TIA/EIA-95-B Mobile Station-Base Station Compatibility Standard for Dual-Mode Wideband Spread Spectrum Cellular System" (the IS-95 standard), (2) the standard offered by a consortium named"3rd Generation Partnership Project" (3GPP) and embodied in a set of documents including Document Nos. 3G TS 25.211, 3G TS 25.212, 3G TS 25.213, and 3G TS 25.214 (the W-CDMA standard), (3) the standard offered by a consortium named"3$^{rd}$ Generation Partnership Project 2" (3GPP2) and embodied in"TR-45.5 Physical Layer Standard for cdma2000 Spread Spectrum Systems" (the IS-2000 standard), and (4) the high data rate (HDR) system that conforms to the TIA/EIA/IS-856 standard (the IS-856 standard).

The golf clubs 50 of the present invention comprise irons, drivers, putters, fairway woods, hybrids, and wedges. The following patents relate to the golf clubs 50 that may be used in the present invention and are hereby incorporated by reference.

Gibbs, et al., U.S. Pat. No. 7,163,468 is hereby incorporated by reference in its entirety.

Galloway, et al., U.S. Pat. No. 7,163,470 is hereby incorporated by reference in its entirety.

Williams, et al., U.S. Pat. No. 7,166,038 is hereby incorporated by reference in its entirety.

Desmukh U.S. Pat. No. 7,214,143 is hereby incorporated by reference in its entirety.

Murphy, et al., U.S. Pat. No. 7,252,600 is hereby incorporated by reference in its entirety.

Gibbs, et al., U.S. Pat. No. 7,258,626 is hereby incorporated by reference in its entirety.

Galloway, et al., U.S. Pat. No. 7,258,631 is hereby incorporated by reference in its entirety.

Evans, et al., U.S. Pat. No. 7,273,419 is hereby incorporated by reference in its entirety.

Hocknell, et al., U.S. Pat. No. 7,413,520 is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A system for automatically tracking a golf club swung by a golfer, the system comprising:

a plurality of golf clubs, each of the plurality of golf clubs comprising a shaft and a golf club head, the shaft having a device comprising an accelerometer in electrical communication with an active radiofrequency component, the accelerometer temporarily closing a switch during impact with a golf ball to provide power from a power source to the active radiofrequency component for transmission of a signal, wherein the signal comprises the type of club and force of the shot, each device further comprising a resistor and a capacitor, and the power source comprising a battery limited to 75 milliamps of power, wherein the resistor controls a rate at which the capacitor is charged from the battery in order to conserve power;

a receiver for receiving the signal from the active radiofrequency component, wherein the receiver is a GPS unit, wherein the receiver stores data for each shot by the golfer for a round of golf;

wherein in order to conserve battery power, the active radiofrequency component transmits the signal until a confirmation signal is received by the receiver or until a threshold number of signals are sent from the active radiofrequency component without the confirmation signal, the threshold number of signals ranging from 20 to 50.

* * * * *